US010837257B2

(12) United States Patent
Song et al.

(10) Patent No.: US 10,837,257 B2
(45) Date of Patent: Nov. 17, 2020

(54) RUBBER CYLINDER WITH RIGID SEAL RINGS ON BOTH ENDS, PACKER, AND BRIDGE PLUG

(71) Applicant: TIANDING SEALING TECHNOLOGY (BEIJING) CO., LTD., Beijing (CN)

(72) Inventors: Wei Song, Beijing (CN); Xuewu Long, Beijing (CN)

(73) Assignee: Tianding Sealing Technology (Beijing) Co., Ltd., Beijing (CN)

( * ) Notice: Subject to any disclaimer, the term of this patent is extended or adjusted under 35 U.S.C. 154(b) by 0 days.

(21) Appl. No.: 16/305,053

(22) PCT Filed: May 22, 2017

(86) PCT No.: PCT/CN2017/085367
§ 371 (c)(1),
(2) Date: Nov. 27, 2018

(87) PCT Pub. No.: WO2018/036224
PCT Pub. Date: Mar. 1, 2018

(65) Prior Publication Data

US 2019/0264530 A1 Aug. 29, 2019

(30) Foreign Application Priority Data

Aug. 22, 2016 (CN) ..... 2016 1 0701164

(51) Int. Cl.
*E21B 33/128* (2006.01)
*E21B 33/134* (2006.01)
*E21B 33/12* (2006.01)

(52) U.S. Cl.
CPC ..... *E21B 33/128* (2013.01); *E21B 33/134* (2013.01); *E21B 33/1208* (2013.01); *E21B 33/1216* (2013.01)

(58) Field of Classification Search
CPC .. E21B 33/128; E21B 33/134; E21B 33/1216; E21B 33/1208
See application file for complete search history.

(56) References Cited

U.S. PATENT DOCUMENTS 5,165,703 A * 11/1992 Morvant ..... E21B 33/1208 277/342

FOREIGN PATENT DOCUMENTS

CN 105863552 A 5/2016

OTHER PUBLICATIONS

U.S. Appl. No. 16/301,727, filed Aug. 2019, Song; Wei.*
(Continued)

*Primary Examiner* — D. Andrews
*Assistant Examiner* — Manuel C Portocarrero
(74) *Attorney, Agent, or Firm* — Loeb & Loeb LLP

(57) ABSTRACT

A rubber cylinder includes rigid seal rings on both ends, a packer, and a bridge. The rubber cylinder comprises a wire seal ring, a filament seal ring, and rigid seal rings. The wire seal ring abuts the filament seal ring and is disposed below the filament seal ring. The wire seal ring comprises a plurality of wires intersecting each other and a colloid bonding all the wires together. The filament seal ring comprises a plurality of high-temperature high-pressure resistant filaments intersecting each other and a colloid bonding all the filaments together. When the wire seal ring is disposed below the filament seal ring, friction between the wire seal ring and a central tube and/or a casing reduces an axial pressure transferred to the filament seal ring. Such reduction further reduces the occurrence of an extruded shoulder.

9 Claims, 11 Drawing Sheets

(56) References Cited

OTHER PUBLICATIONS

Chinese International Searching Authority, International Search Report and Written Opinion, dated Aug. 4, 2017, 7 pages.
Canadian Intellectual Property Office, Office action, dated Dec. 11, 2019, 5 pages.

* cited by examiner

RUBBER CYLINDER WITH RIGID SEAL RINGS ON BOTH ENDS, PACKER, AND BRIDGE PLUG

CROSS REFERENCE OF RELATED APPLICATIONS

The present invention is a US national stage of a PCT international application, serial no. PCT/CN/2017/085367, filed on May 22, 2017, which claims the priority of Chinese patent application No. 201610701164.6, filed with SIPO of China on Aug. 22, 2016 having an invention title of "RUBBER CYLINDER WITH RIGID SEAL RINGS ON BOTH ENDS, PACKER, AND BRIDGE PLUG", the entire content of these applications are incorporated into the present application by reference herein.

TECHNICAL FIELD

The present application relates to the field of sealing, and in particular, to a rubber cylinder with rigid seal rings on both ends, a packer, and a bridge plug that are used in the petroleum production industry and can withstand high temperature and high pressure.

BACKGROUND OF THE INVENTION

Packers are critical tools used for downhole production in oil fields, and are widely applied to various works such as oil field injection, separated-zone transformation, separated-zone production, and mechanical channel plugging. A packer needs to provide an annular seal to implement oil-gas separation. A rubber cylinder is a core component for implementing an annular seal. A bridge plug is also a commonly used oil-gas separation tool in production work. A major difference between a packer and a bridge plug lies in that a packer is usually kept in a well temporarily during operations of measures such as fracturing, acidising, and leakage finding. A bridge plug is temporarily or permanently kept in a well during measures such as isolation of a zone for production. A packer is kept in a well together with a central tube. When being equipped with a release, a packer can be separately kept in a well. A bridge plug can be separately kept in a well. Structurally, a packer has a hollow structure in which oil, gas or water can flow freely, whereas a bridge plug is a solid structure.

As oil-gas separation tools, both a packer and a bridge plug need a rubber cylinder. A rubber cylinder is a critical component for sealing. The sealing effect and service life of a packer and a bridge plug directly depend on the quality of a rubber cylinder, which is therefore critical for a packer and a bridge plug. The name is "rubber cylinder" because a rubber cylinder is usually made of a rubber material. However, "rubber cylinder" is only a technical term commonly accepted in the industry and used to represent a functional component having a sealing effect, but does not only indicate that a rubber cylinder can be made of rubber only. When a rubber cylinder bears a particular pressure and therefore deforms for sealing, the deformability of the rubber cylinder needs to be considered. If deforming insufficiently, the rubber cylinder cannot produce a sealing effect. If deforming excessively, the rubber cylinder may collapse and fail, and loose recover ability. The most important part is that when a rubber cylinder is exposed to high-temperature steam in a well, the rubber cylinder will fail and loose recover ability more, since it is affected by both high temperature and high pressure.

Issue 9 (2002) of China Petroleum Machinery discloses New "Anti-extrusion" Structure for Compressed Rubber Cylinders of Packers, in which the following content is recorded: "In the so-called anti-extrusion, a stop ring, a support member, a limit apparatus, a protection member or the like is placed at an end portion of a rubber cylinder, and is used to prevent and limit the rubber cylinder from extruding or flowing towards a casing-tubing annulus space during packer setting". "An anti-extrusion structure is used to cover an annular gap between a packer and a casing. Therefore, during packer setting, once a rubber cylinder deforms and comes into contact with the wall of the casing, under the effect of an external load, an anti-extrusion apparatus unfolds to cover a annular clearance between the packer and the wall of the casing, to prevent the rubber cylinder from extruding towards the annular clearance and force the rubber cylinder to be in a state of being uniformly compressed in all directions, so as to generate and maintain relatively high contact stress of rubber cylinder, thereby obtaining a desirable seal". " . . . mainly comprise copper-bowl curing type and steel-mesh or steel-strip curing type. In the copper-bowl curing type, two 2-mm-thick copper bowls are respectively cured on end surfaces of two end rubber cylinders. In steel-mesh or steel-strip curing type, approximately 1-mm-thick steel meshes or steel strips are respectively cured on end surfaces of two end rubber cylinders".

Issue 1 (2013) of Oil Field Equipment discloses an article entitled Analysis of Comparative Advantage and Structure Improvement of Packer Rubber, in which the following content is recorded: "Three rubber cylinders are sleeved on a common packer, and two structural forms are comprised. In one structural form, an upper rubber cylinder, a middle rubber cylinder, and a lower rubber cylinder have the same size. In the other structural form, an upper rubber cylinder and a lower rubber cylinder are long rubber cylinders, and a middle rubber cylinder is a short rubber cylinder. It is found by researching a conventional three-rubber-cylinder structure that the upper rubber cylinder produces the primary sealing effect". Moreover, it is found by performing nonlinear analysis by using the nonlinear finite element analysis software Abaqus that: "As the axial load increases, the axial compression amount also increases. The increase of the compression amount is relatively obvious at the beginning. The increase of the compression amount slows down later, and the deformation of the rubber cylinder tends to be stable. As the setting force increases, the length of contact between the rubber cylinder and the casing gradually increases. The radial deformation of the outer column surface part of the rubber cylinder is restricted, and the deformation of the inner surface of the rubber cylinder protrudes outwardly as the outer surface. When the load increases, the rubber cylinder is flattened and is eventually compacted. However, due to structural limitations, only the upper rubber cylinder can be compacted. When the operating pressure is 30 MPa, the upper rubber cylinder is basically completely compacted. A slightly extruded shoulder appears at an upper end of the rubber cylinder, but a rupture phenomenon does not occur in the rubber cylinder. The extruded shoulder is within an allowable range".

It is considered in Improvement of High Pressure Rubber Barrel of Packers in Issue 1 (2009) of Oil Field Equipment that "because the surface layer of rubber ruptures easily, it is considered to add one metal sheet (for example, a copper sheet) to the surface layer of rubber".

However, only the influence on the deformation of a rubber cylinder by applying a first axial pressure (equivalent to "the axial load") has been analysed in the foregoing prior art. However, during actual production, one first axial pressure from top to bottom needs to be first applied to the rubber cylinder to enable the rubber cylinder to create an initial seal. The rubber cylinder is then subject to one second axial pressure (the impact on the rubber cylinder by a substance such as a downhole gas) from bottom to top. According to experiments by the inventors, when the first axial pressure is 30 MPa, the inventors find that extruded shoulders appear on almost all rubber cylinders, and when the second axial pressure (for example, 15 MPa or 20 MPa) is then further applied, ruptures occur at the extruded shoulders of all the rubber cylinders, causing the seal to fail.

Further, the inventors further find that even if a seal can be transiently created by a rubber cylinder when a second axial pressure is applied, as a substance such as a downhole gas impacts the rubber cylinder, small molecules of high temperature and high pressure steam contained in the substance may cause a polymeric rubber cylinder to degrade. As a result, a lower end portion of the rubber cylinder first loses elasticity and cannot produce a sealing effect, and the durability of a seal of the rubber cylinder is affected.

SUMMARY OF THE INVENTION

The invention provides a rubber cylinder having a new structural design, to prevent or reduce an extruded shoulder that occurs on a rubber cylinder.

According to an aspect of the present application, a rubber cylinder with rigid seal rings on both ends is provided, having a through hole located at the centre, an inner surface located at the through hole, an outer surface corresponding to the inner surface, an upper end portion and a lower end portion respectively located at two ends of the rubber cylinder, and a middle portion located between the upper end portion and the lower end portion, the upper end portion being used to bear a first axial pressure in an axial direction, and the lower end portion being used to bear a second axial pressure opposite to the first axial pressure in the axial direction; when the first axial pressure is applied to the upper end portion, the upper end portion, the middle portion, and the lower end portion all deforming in a radial direction; and when the second axial pressure is applied to the lower end portion, the upper end portion, the middle portion, and the lower end portion all deforming in the radial direction, wherein the rubber cylinder comprises more than one wire seal ring and more than one filament seal ring arranged in the axial direction, and one of the wire seal rings abuts one of the filament seal rings and is disposed below the filament seal ring;

the wire seal ring comprises a plurality of wires intersecting each other and a colloid bonding all the wires together;

the filament seal ring comprises a plurality of high-temperature high-pressure resistant filaments intersecting each other and a colloid bonding all the filaments together; and one rigid seal ring is disposed at an upper end of the rubber cylinder and is used as the upper end portion of the rubber cylinder, and another rigid seal ring is disposed at a lower end of the rubber cylinder and is used as the lower end portion of the rubber cylinder.

Preferably, an abutting first spacer ring is disposed below one of the wire seal rings, an abutting second spacer ring is disposed above the filament seal ring abutting the wire seal ring, and a hardness of the first spacer ring and a hardness of the second spacer ring are both greater than a hardness of the wire seal ring and a hardness of the filament seal ring; and no spacer ring is disposed between the wire seal ring and the filament seal ring abutting the wire seal ring.

Preferably, the first spacer ring and the second spacer ring are both made of a metal material.

Preferably, the first spacer ring and the second spacer ring are both made of an aluminium material; and a thickness of the first spacer ring is D1, a thickness of the second spacer ring is D2, 4 mm≤D1≤6 mm, and 4 mm≤D2≤6 mm.

Preferably, the thickness of the first spacer ring is 5 mm.

Preferably, the thickness of the second spacer ring is 5 mm.

Preferably, the first spacer ring and the second spacer ring are both made of an iron material; and a thickness of the first spacer ring is D1, a thickness of the second spacer ring is D2, 2 mm≤D1≤4 mm, and 2 mm≤D2≤4 mm.

Preferably, the thickness of the first spacer ring and the thickness of the second spacer ring are both 3 mm.

The rigid seal rings are graphite seal rings, and each of the graphite seal rings comprises high-temperature high-pressure resistant carbon filaments intersecting each other and graphite bonding all the carbon filaments together.

Further preferably, the graphite seal ring is covered with a copper sheet.

According to another aspect of the present application, a packer is provided, the packer having the rubber cylinder defined in one of the foregoing technical solutions.

According to still another aspect of the present application, a bridge plug is provided, the bridge plug having the rubber cylinder defined in one of the foregoing technical solutions.

The technical solutions provided in the present application at least have the following technical effects:

According to the technical solutions of the present application, the hardness of the upper end portion is greater than the hardness of the middle portion. In this way, when the upper end portion is subject to the first axial pressure, the upper end portion more likely transfers the first axial pressure to the middle portion and the lower end portion instead of deforming radially itself. In this way, a relatively small first axial pressure can be used to enable the middle portion and the lower end portion to deform radially, thereby achieving an overall seal of the rubber cylinder.

According to the technical solutions of the present application, if the hardness of the middle portion is kept unchanged, in the present application, the hardness of the upper end portion is set to be greater than the hardness of the middle portion. In this way, under the effect of the same first axial pressure, the deformation of the upper end portion in the radial direction is relatively small. It should be particularly noted that correspondingly an extruded shoulder formed on the upper end portion due to radial deformation is also relatively small. The relatively small extruded shoulder can effectively prevent the rubber cylinder from rupturing, thereby achieving the effect of preventing the seal of the rubber cylinder from failing.

In an embodiment, because a base body comprises a plurality of filaments, a seal ring is slightly harder when a quantity of filaments is relatively large, and a seal ring is slightly softer when a quantity of filaments is relatively small. In this way, a hardness of a seal ring can be adjusted according to the quantity of filaments. In this way, the overall hardness of a rubber cylinder can be directly changed by changing a hardness of a seal ring, thereby achieving the objective of expanding the compressive strength range of the rubber cylinder. Moreover, when the rubber cylinder expands under the first axial pressure, the filaments restrict the expansion, so as to increase the overall structural hardness of the rubber cylinder, thereby increasing the compressive strength of the rubber cylinder.

A plurality of seal rings used in the present application are axially arranged. If an individual seal ring is damaged during petroleum production, the damaged seal ring may be replaced with a new seal ring, and the remaining seal rings are not replaced. In this way, on the whole, the average use duration of a single seal ring is increased, so that the usage of rubber cylinders can be greatly reduced and production costs can be reduced.

When a packing is chosen for the base body of the present application, an existing high-temperature high-pressure resistant packing may be chosen. In this way, when a colloid is combined with a graphite packing or a carbon fibre packing to form a seal ring, the entire packing can produce a support effect, and the colloid can produce the effects of deformation and sealing enhancement. An existing packing is chosen in the present application, and a dedicated packing to be used as the base body does not need to be fabricated, so that the flexibility of production can be improved. As far as the inventors are aware, an existing graphite packing and an existing carbon fibre packing can withstand the effects of high temperature and high pressure, but have relatively poor resilience. In the present application, the colloid is dispersed in the packing, and the colloid facilitates the recovery of the compressed packing after the first axial pressure disappears, making it easy to remove the rubber cylinder from a borehole.

When the wire seal ring of the present application is disposed below the filament seal ring, an axial pressure transferred to the filament seal ring is reduced due to the friction between the wire seal ring and a central tube and/or a casing. In this case, an axial pressure exerted on the filament seal ring can be effectively reduced. An extruded shoulder is generated because of an excessively large axial pressure. Therefore, such a design can reduce or prevent the occurrence of an extruded shoulder.

DESCRIPTION OF THE DRAWINGS

Some of the particular embodiments of the present application will be described below in detail in an exemplary but not limiting way with reference to the accompanying drawings. The same reference signs indicate the same or similar components or parts in the accompanying drawings. In the accompanying drawings.

Figure 1:
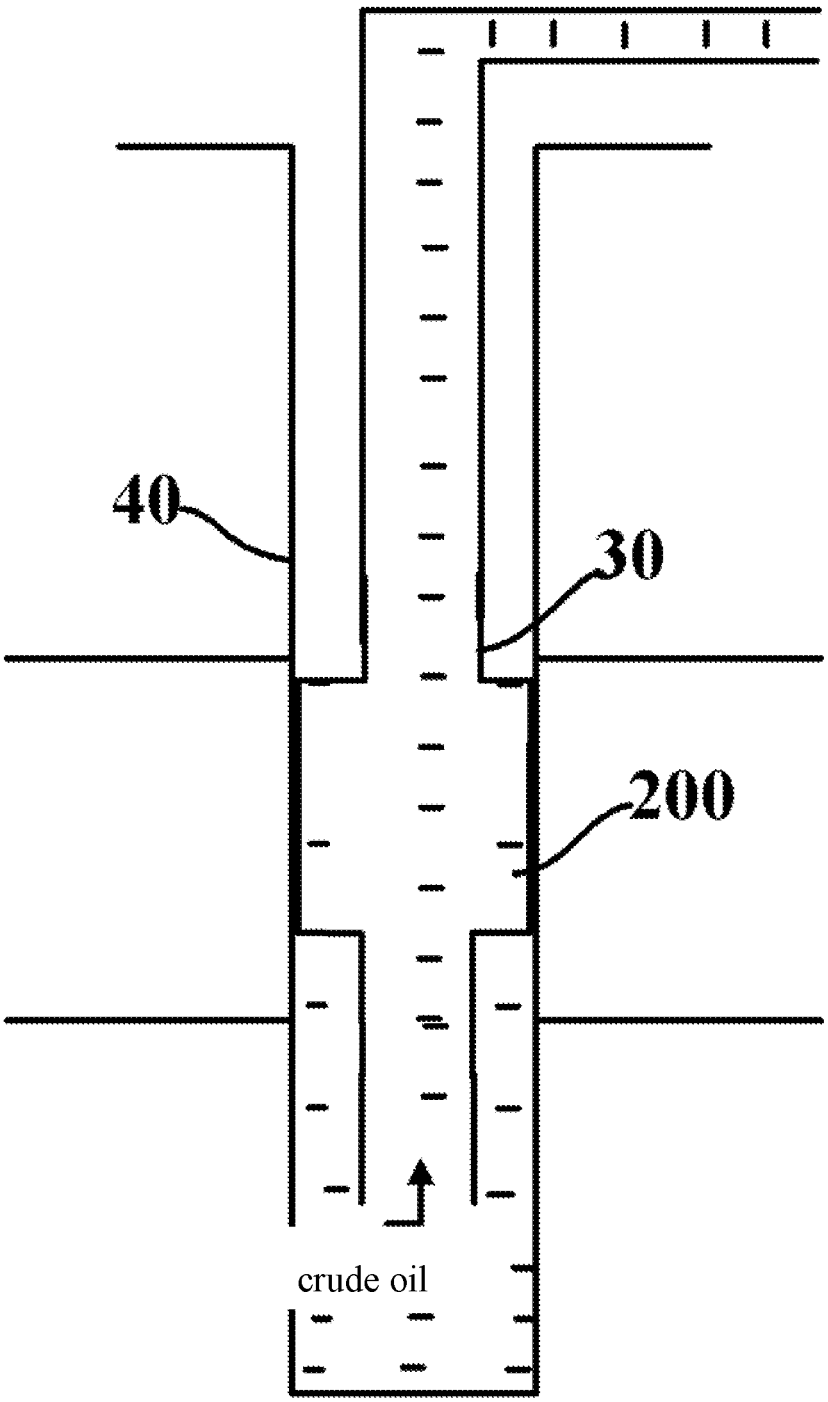
FIG. 1 is a schematic view of a position relationship between a compression packer comprising a rubber cylinder according to an embodiment of the present application and a central tube and a casing.

The reference numerals in the drawings are as follows:

10—Rubber cylinder, 101—Outer surface, 102—Inner surface, 103—Through hole, 104—Upper end portion, 105—Middle portion, 106—Lower end portion, and 107—Extruded shoulder;

108—Base body, 109—Colloid, 111—First copper sheet, 111*a*—Inner side copper sheet, 111*b*—Outer side copper sheet, 111*c*—Opening, 111*d*—Upper side copper sheet, 111*e*—Lower side copper sheet, 112—Second copper sheet, and 113—Third copper sheet;

30—Central tube;

40—Casing;

51—First spacer ring, 52—Second spacer ring, 53—Third spacer ring, and 54—Fourth spacer ring;

70—Seal ring, 71—Wire seal ring, 72—Filament seal ring, and 73—Graphite seal ring;

200—Compression packer;

A—First axial direction;

B—Second axial direction;

F1—First axial pressure; and

F2—Second axial pressure.

DETAILED DESCRIPTION OF THE INVENTION

The directions "up" and "down" hereinafter are both described with reference to FIG. 2.

A compression packer 200 shown in FIG. 1 has a rubber cylinder 10 of the present application. The compression packer 200 is connected to a central tube 30 and is placed inside a casing 40. The compression packer 200 needs to separate different oil-bearing layers and water-bearing layers in a wellbore and bear particular pressure differences. It is required that the compression packer 200 can reach down a predetermined position in a wellbore and provide tight sealing, and is durable in a downhole and can be successfully removed as required.

Figure 2:
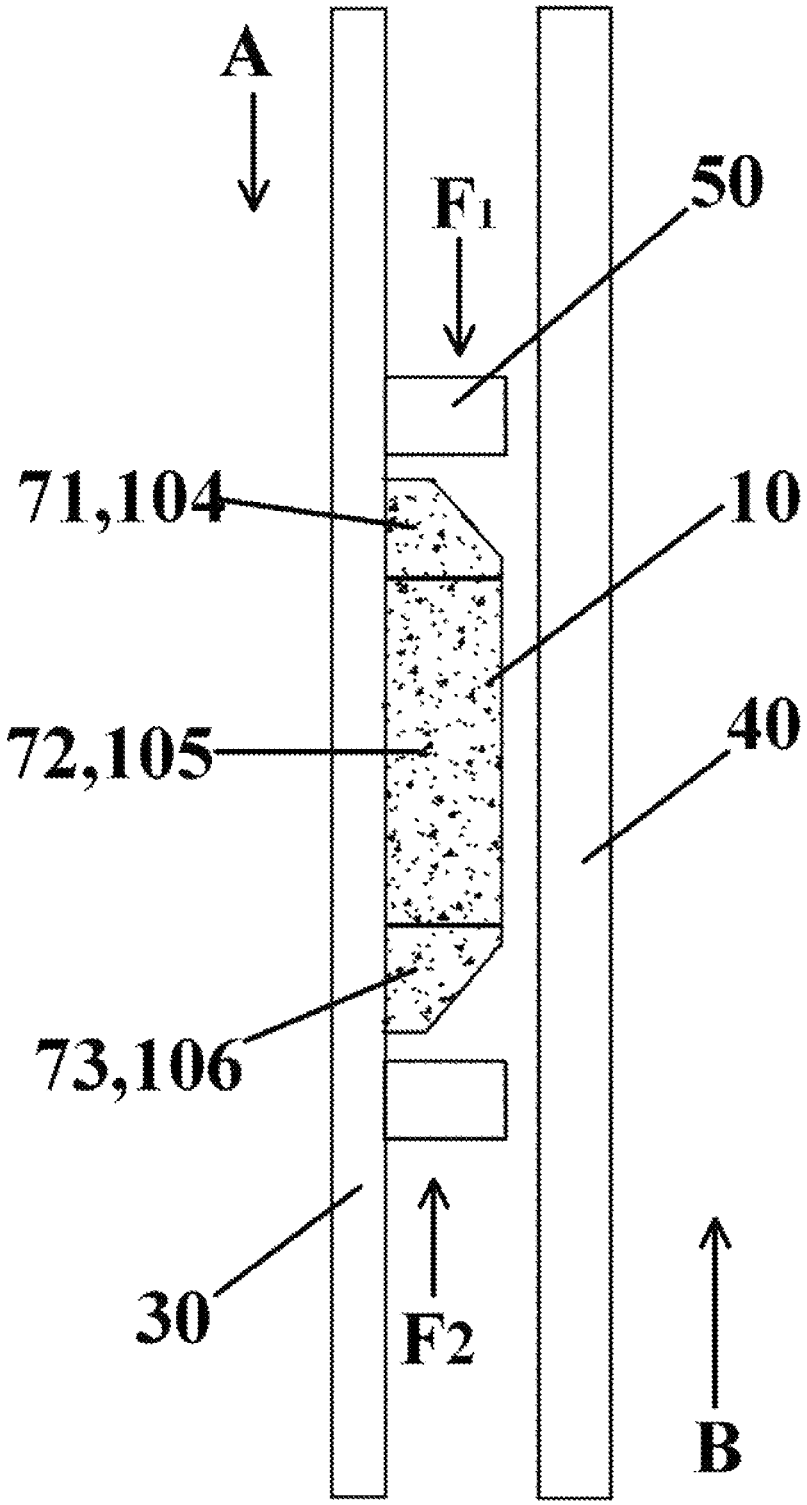
FIG. 2 is a schematic view of a position relationship between a rubber cylinder according to an embodiment of the present application and a central tube and a casing, wherein only a part of the rubber cylinder, the central tube, and the casing is shown.

As shown in FIG. 2, the rubber cylinder 10 is located in an annular gap formed by the casing 40 and the central tube 30. A stiff spacer ring 50 provides a first axial pressure F1 from top to bottom (that is, a first axial direction A) in an axial direction. In another embodiment, the stiff spacer ring 50 may further be omitted and replaced by another component that can apply the first axial pressure F1 to the rubber cylinder 10. As shown in FIG. 2, two ends of the rubber cylinder 10 are an upper end portion 104 and a lower end portion 106, and a middle portion 105 is located between the upper end portion 104 and the lower end portion 106. The upper end portion 104 is used to bear the first axial pressure F1 in the axial direction, and the lower end portion 106 is used to bear a second axial pressure F2 opposite to the first axial pressure F1 in the axial direction. As parts of the rubber cylinder 10, the upper end portion 104, the lower end portion 106, and the middle portion 105 should all have elasticity. As an explanation of the elasticity and restrictions to the magnitude of elasticity, when the first axial pressure F1 is applied to the upper end portion 104, the upper end portion 104, the middle portion 105, and the lower end portion 106 all deform in a radial direction; and when the second axial pressure F2 is applied to the lower end portion 106, the upper end portion 104, the middle portion 105, and the lower end portion 106 all deform in the radial direction. In the embodiment shown in FIG. 2, each of the upper end portion 104 and the lower end portion 106 has a bevel, and the bevel may alternatively be not set in another embodiment.

Figure 3:
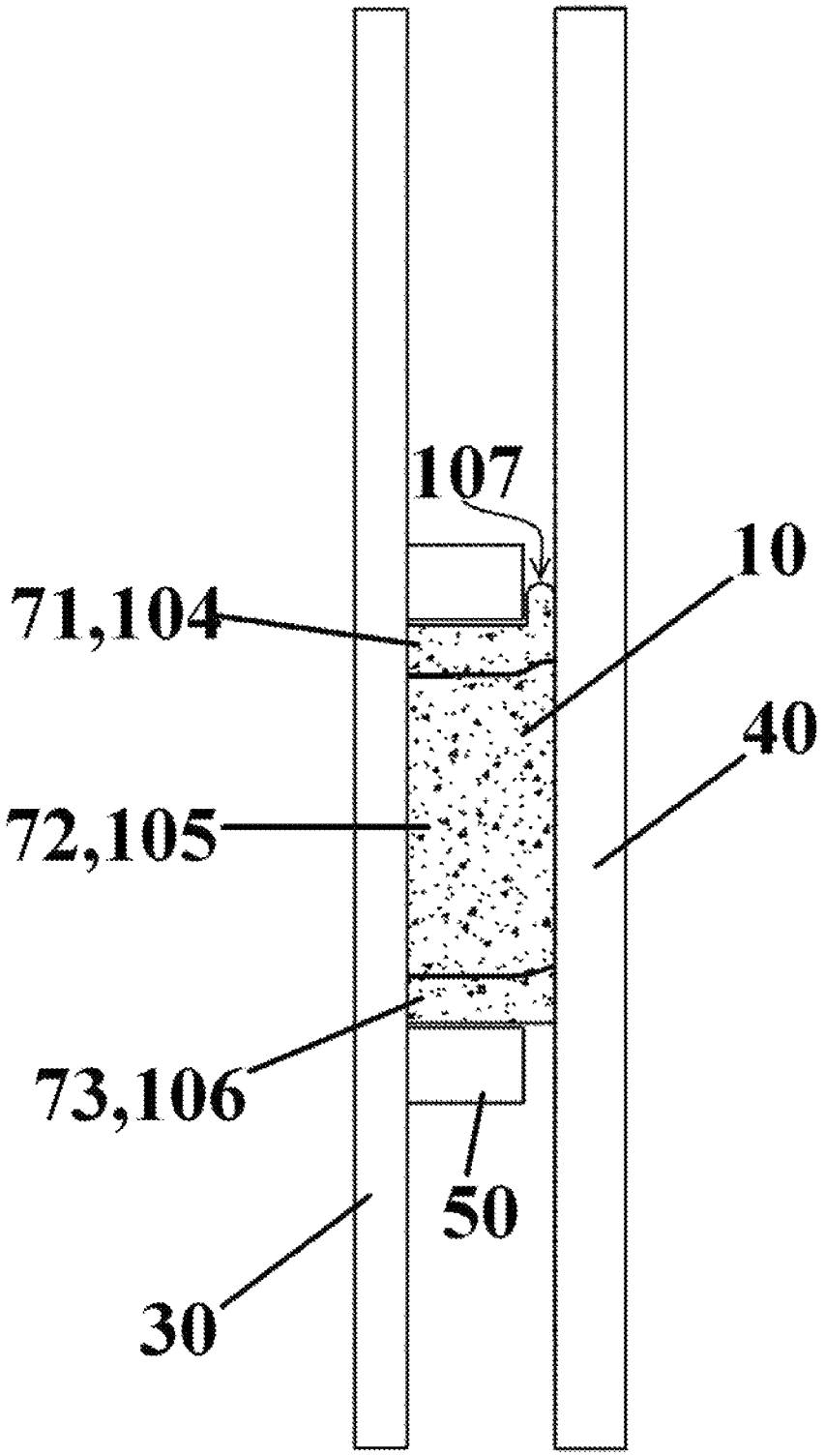
FIG. 3 is a schematic view of a position relationship between an extruded shoulder generated after a first axial pressure is applied to the rubber cylinder shown in FIG. 2 and the central tube and the casing, wherein at this time a second axial pressure has not been applied to the rubber cylinder yet.

As shown in FIG. 3, the inventors find that when the upper end portion 104 is subject to the first axial pressure F1, the upper end portion 104 generates a large extruded shoulder 107. When the second axial pressure F2 is then applied, the upper end portion 104 ruptures at the extruded shoulder 107 shown in FIG. 3.

The structural design for reducing or preventing the extruded shoulder 107 in the present application is described below.

Figure 4:
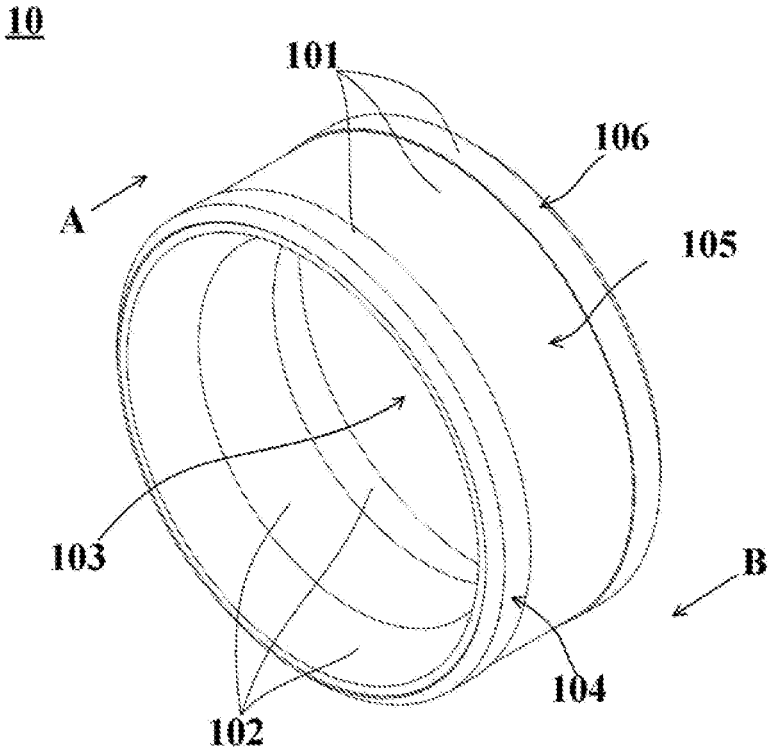
FIG. 4 is a schematic structural view of a rubber cylinder according to an embodiment of the present application.

In the embodiment shown in FIG. 4, the rubber cylinder 10 is overall cylindrical. The rubber cylinder 10 has a through hole 103 located at the centre. The through hole 103 is formed being defined by an inner surface 102. An outer surface 101 is located on an outer side of the through hole 103 corresponding to the inner surface 102. When the first axial pressure F1 acts on the upper end portion 104 in the first axial direction A or the second axial pressure F2 acts on the lower end portion 106 in a second axial direction B, the rubber cylinder 10 is overall axially compressed to expand radially (having the same meaning as "deform in the radial direction"), making the outer surface 101 protrude outwardly and the inner surface 102 protrude inwardly. However, in a time order, the outer surface 101 generally partially protrudes outwardly first. After the first axial pressure F1 is applied, the inner surface 102 is sealed with the central tube 30 in FIG. 1 and FIG. 2, and the outer surface 101 is sealed with the casing 40 in FIG. 1 and FIG. 2. Generally, the inner surface 102 and the central tube 30 have a relatively small gap (are nearly attached to each other), and the outer surface 101 and the casing 40 have a relatively large gap. The central tube 30 and the casing 40 respectively restrict the sizes of the largest protrusions of the inner surface 102 and the outer surface 101. Therefore, the degree of an outward protrusion on the outer surface 101 is greater than the degree of an inward protrusion on the inner surface 102.

A design for reducing the extruded shoulder 107 is as follows:

As discussed above, the upper end portion 104, the lower end portion 106, and the middle portion 105 should all have elasticity. However, in the embodiments shown in FIG. 2 and FIG. 4, a hardness of the upper end portion 104 is greater than a hardness of the middle portion 105. Therefore, when the upper end portion 104 bears the first axial pressure F1, the deformation of the middle portion 105 in the radial direction is greater than the deformation of the upper end portion 104 in the radial direction.

The hardness of the upper end portion 104 is greater than the hardness of the middle portion 105. In this case, when the upper end portion 104 is subject to the first axial pressure F1, the upper end portion 104 more likely transfers the first axial pressure F1 to the middle portion 105 and the lower end portion 106 instead of deforming radially itself. In this way, the middle portion 105 and the lower end portion 106 can deform radially when a relatively small first axial pressure F1 is used, so as to achieve an overall seal of the rubber cylinder 10. The inventors find in experiments that if the hardness of the upper end portion 104 is not greater than the hardness of the middle portion 105, when the upper end portion 104 is subject to the first axial pressure F1, the first axial pressure F1 is more likely used to make the upper end portion 104 deform radially instead of being transferred to the middle portion 105 and the lower end portion 106, thereby preventing or reducing the extruded shoulder 107 shown in FIG. 3.

According to the technical solutions of the present application, if the hardness of the middle portion 105 is kept unchanged, in the present application, the hardness of the upper end portion 104 is set to be greater than the hardness of the middle portion 105. In this way, when being subject to the effect of the same first axial pressure F1, the deformation of the upper end portion 104 in the radial direction is relatively small. It should be particularly noted that, the extruded shoulder 107 correspondingly formed by the upper end portion 104 due to radial deformation is also relatively small. The relatively small extruded shoulder 107 can effectively prevent the rubber cylinder 10 from rupturing, thereby achieving the effect of preventing the seal of the rubber cylinder 10 from failing.

The radial deformation of the upper end portion 104 is relatively small. Therefore, it is highly likely that in this case the deformation of the upper end portion 104 in the radial direction is already insufficient for sealing the casing 40 and the central tube 30. That is, in this case, the upper end portion 104 no longer produces a sealing effect, but instead, only transfers the first axial pressure F1 applied to the upper end portion 104 to the middle portion 105 and the lower end portion 106. This is one major difference between the rubber cylinder 10 of the present application and a rubber cylinder in the prior art. Moreover, even if the radial deformation of the upper end portion 104 is relatively large to seal the casing 40 and the central tube 30, in this case, the seal of the upper end portion 104 is also only a supplement to the seal of the rubber cylinder 10. Regardless of whether the upper end portion 104 produces a sealing effect, by setting the hardness of the upper end portion 104 to be greater than the middle portion 105, the rubber cylinder 10 is prevented from rupturing because the extruded shoulder 107 is excessively large, and a relatively small first axial pressure F1 can also be used to seal the rubber cylinder 10.

According to the technical solutions of the present application, if the hardness of the middle portion 105 is kept unchanged, in the present application, the hardness of the upper end portion 104 is set to be greater than the hardness of the middle portion 105. However, in this case, the upper end portion 104 may be not in contact with the casing 40 under the effect of the first axial pressure F1 and fail to produce a sealing effect. In the special structure, when a hardness of the lower end portion 106 is basically the same as the hardness of the middle portion 105, the seal of the rubber cylinder of the present application is provided by the lower end portion 106 and the middle portion 105. When the hardness of the lower end portion 106 is basically the same as the hardness of the upper end portion 104, the seal of the rubber cylinder of the present application is provided by the middle portion 105. In this case, the structure for producing a sealing effect of the rubber cylinder 10 of the present application is completely different from that of the rubber cylinder in the prior art.

As a preferred embodiment, when an outer wall of the upper end portion 104 abuts an inner wall of the casing 40, more preferably, when the outer wall of the upper end portion 104 and the inner wall of the casing 40 are sealed, in this case, a lower portion of the upper end portion 104 covers an upper portion of the middle portion 105 with a basically equal area. The upper end portion 104 and the middle portion 105 are basically not different in the radial direction, so that a downward pressing effect can be produced at a joint between the middle portion 105 and the upper end portion 104, thereby preventing or reducing an extruded shoulder at the joint between the middle portion 105 and the upper end portion 104.

To achieve the effect of "more likely transfers the first axial pressure F1 to the middle portion 105 and the lower end portion 106 instead of deforming radially" as discussed above and the effect of preventing the extruded shoulder 107 from generating on the upper end portion 104, a metal block such as an iron block that does not deform easily can be used. If the metal block has a relatively small diameter, a larger extruded shoulder 107 is generated on the middle portion 105 in contact with the metal block. If the metal block has a relatively large diameter, considering bending of the casing 40, it is not easy for the metal block to slide to a suitable position in the casing 40. Especially, it is not easy when considering that a sliding distance may be 1 kilometre long and a protruding foreign object exists on the inner wall of the casing 40. Moreover, if a foreign object enters the casing 40, it is also not easy to pull a relatively large metal block away from the casing. In another aspect, a metal block cannot be pulled away from the casing 40 if a lift force is relatively small, whereas the casing 40 may be damaged if the lift force is relatively large. Under comprehensive consideration, the upper end portion 104 used in the present application has elasticity, but the elasticity of the upper end portion 104 needs to be restricted. That is, the hardness of the upper end portion 104 is greater than the hardness of the middle portion 105. In this way, the upper end portion 104 may have a relatively small diameter, so that the upper end portion 104 moves in the casing conveniently. For example, the diameter of the upper end portion 104 may be the same as that of the middle portion 105. Because the upper end portion 104 has higher hardness, the extruded shoulder 107 does not form easily on the upper end portion 104 or the formed extruded shoulder 107 is relatively small. When being compressed, the upper end portion 104 gradually extends in the radial direction and deforms, and therefore a gap between the upper end portion 104 and the casing 40 is reduced, so that an extruded shoulder is prevented from being formed on the middle portion 105 or the size of a formed extruded shoulder is reduced.

In an embodiment, the hardness of the lower end portion 106 is greater than the hardness of the middle portion 105, so that when the lower end portion 106 bears the second axial pressure F2, the deformation of the middle portion 105 in the radial direction is greater than the deformation of the lower end portion 106 in the radial direction. Based on the same principle, such a structure can prevent the extruded shoulder from being generated when the lower end portion 106 bears the first axial pressure F1 or the second axial pressure F2, and can prevent the extruded shoulder from becoming larger when the lower end portion 106 further bears the second axial pressure F2 if the extruded shoulder is already generated, thereby preventing the lower end portion 106 from being ruptured to cause the seal of the rubber cylinder 10 to fail.

In another embodiment, the hardness of the upper end portion 104 is basically the same as that of the lower end portion 106. That is, the hardness of the upper end portion 104 and the hardness of the lower end portion 106 are both greater than that of the middle portion 105. In this way, under either the first axial pressure F1 or the second axial pressure F2, the deformation of the middle portion 105 is larger than both the deformation of the upper end portion 104 and the deformation of the lower end portion 106. Such a structure can enable the middle portion 105 to rapidly reach a sealed state, and prevent an extruded shoulder from occurring in the upper end portion 104 and the lower end portion 106 or prevent an extruded shoulder generated in the upper end portion 104 and the lower end portion 106 from becoming larger.

In the embodiments shown in FIG. 2, FIG. 3, and FIG. 4, the rubber cylinder 10 is formed of three parts, that is, the upper end portion 104, the lower end portion 106, and the middle portion 105. FIG. 4 is used as an example. In the first axial direction A, that is, the direction from top to bottom, three seal rings 70 are respectively used as the upper end portion 104, the lower end portion 106, and the middle portion 105. However, usually at least two seal rings 70 are used as the middle portion 105.

Another design for reducing the extruded shoulder 107 is as follows:

"In the so-called anti-extrusion, a stop ring, a support member, a limit apparatus, a protection member or the like is placed at an end portion of a rubber cylinder, and is used to prevent and limit the rubber cylinder from extruding or flowing towards a casing-tubing annulus space during packer setting" is mentioned in the background part.

" . . . mainly comprise copper-bowl curing type and steel-mesh or steel-strip curing type. In the copper-bowl curing type, two 2-mm-thick copper bowls are respectively cured on end surfaces of two end rubber cylinders. In steel-mesh or steel-strip curing type, approximately 1-mm-thick steel meshes or steel strips are respectively cured on end surfaces of two end rubber cylinders" is mentioned in the background part.

The foregoing two existing designs follow the same concept: A constraining member is directly used in a position where an extruded shoulder occurs for restriction to directly prevent the generation of the extruded shoulder. Therefore, a problem that needs to be considered is the hardness of the constraining member: If the constraining member is excessively hard, during the deformation of a rubber cylinder (especially, during the generation of an extruded shoulder), the constraining member may cause a cut in the rubber cylinder. If the constraining member is excessively soft, the effect of preventing an extruded shoulder cannot be produced. Therefore, the constraining member needs to meet a very strict requirement. For example, for the foregoing copper bowl in the prior art, a thickness of the copper bowl needs to be strictly controlled.

"According to experiments by the inventors, when the first axial pressure is 30 MPa, the inventors find that extruded shoulders appear on almost all rubber cylinders, and when the second axial pressure (for example, 15 MPa or 20 MPa) is then further applied, ruptures occur at the extruded shoulders of all the rubber cylinders, causing the seal to fail" is described in the background. The inventors believe that an improvement should be made to the structure of a rubber cylinder to develop a rubber cylinder structure that can provide sealing and does not easily generate an extruded shoulder. However, the difficulty is that the rubber cylinder cannot be very hard to implement the sealing function, and cannot be very soft to prevent an extruded shoulder. If the rubber cylinder is a body having a uniform hardness, a material having a suitable hardness needs to be chosen. According to the prior art, currently, the world has not yet seen a new material developed that can withstand the effects of both a 20-MPa high pressure and a 350° C. high temperature.

Figure 11:
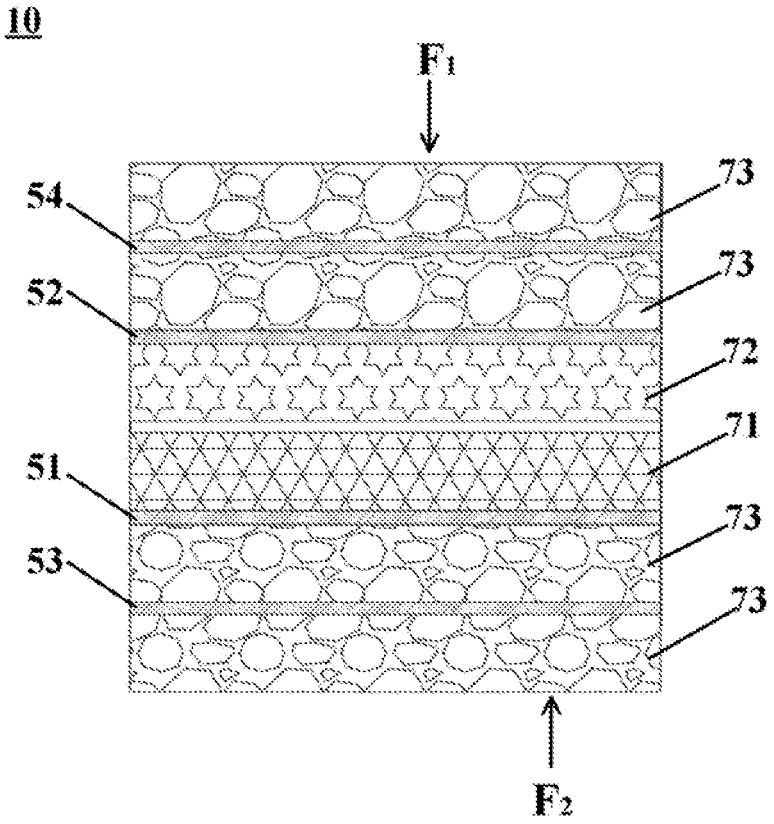
FIG. 11 is a schematic sectional view of a rubber cylinder with a through hole not being shown according to an embodiment of the present application.

A different concept is used in the present application: First, the rubber cylinder 10 of the present application is formed of a plurality of seal rings 70 arranged in an axial direction. In this way, the seal rings 70 may have different hardnesses because of the selection of materials. Two ends of a rubber cylinder 10 provided with a seal ring 70 having a relatively high hardness can prevent the problem of generating an extruded shoulder, whereas a relatively soft seal ring 70 can produce a sealing effect. Further, the rubber cylinder 10 comprises more than one wire seal ring 71 and more than one filament seal ring 72 arranged in the axial direction. One of the wire seal rings 71 abuts one of the filament seal rings 72 and is disposed below the filament seal ring 72. The wire seal ring 71 comprises a plurality of wires intersecting each other and a colloid bonding all the wires together. The filament seal ring 72 comprises a plurality of high-temperature high-pressure resistant filaments intersecting each other and a colloid bonding all the filaments together. The inventors find through a plurality of experiments that an existing filament may break under the effect of a 22-Mpa tensile force. Therefore, the filament seal ring 72 made of a filament may also break easily under the effect of a 22-Mpa axial pressure. Therefore, the inventors choose to use the wire seal ring 71. However, the adhesion between a wire and a colloid is less than that between a filament and a colloid. If the wire seal ring 71 is used for all the parts that produce a sealing effect, under the effect of high pressure, the colloid in the wire seal ring 71 may fall off, rendering the seal of the rubber cylinder 10 impossible. Therefore, in the present application, the wire seal ring 71 and the filament seal ring 72 are used in combination. The reason that the wire seal ring 71 is disposed below the filament seal ring 72 lies in that the inventors find that an extruded shoulder is generated and an extruded shoulder is ruptured more often when the second axial pressure F2 from bottom to top is applied on the rubber cylinder 10. When the wire seal ring 71 is disposed below the filament seal ring 72, an axial pressure transferred to the filament seal ring 72 is reduced due to the friction between the wire seal ring 71 and the central tube 30 and/or the casing 40. In this case, an axial pressure exerted on the filament seal ring 72 can be effectively reduced. An extruded shoulder is generated because of an excessively large axial pressure. Therefore, such a design can reduce or prevent the occurrence of an extruded shoulder. In addition, the wire seal ring 71 is formed of a wire and a colloid. When being subject to the first axial pressure F1, an inner wall and an outer wall of the wire seal ring 71 are basically already in respective contact with the central tube 30 and the casing 40. In this way, in an annulus space formed by the central tube 30 and the casing 40, the wire seal ring 71 is applied to the filament seal ring 72 with an area basically the same as that of the cross section of the annulus space. In addition, compared with a pure-metal anti-extruded-shoulder structure, the wire seal ring 71 has a characteristic of flexibility. The wire seal ring 71 does not cause the filament seal ring 72 to rupture. Especially, as shown in FIG. 11, when the two ends of the rubber cylinder 10 are respectively graphite seal rings 73, because the graphite seal rings 73 have a relative high hardness, in still another preferred embodiment, a copper sheet further covers the graphite seal ring 73. The graphite seal ring 73 does not cause the wire to rupture, and therefore does not cause the wire seal ring 71 to rupture. It should be noted that the graphite seal ring 73 is only one type of rigid seal ring, and may further be a quenched copper ring. In the embodiment shown in FIG. 11, the foregoing two anti-extruded-shoulder designs are combined, and the effect is remarkable.

FIG. 11 only schematically shows one wire seal ring 71 and one filament seal ring 72. In another embodiment, more wire seal rings 71 may further be disposed, and the same quantity of filament seal rings 72 fitting the wire seal ring 71 may be similarly disposed.

The shape and structure of a seal ring 70 are described below in detail.

During experiments, the inventors find that because rubber cylinders 10 have different hardnesses, for example, a rubber cylinder 10 fabricated using polyether ether ketone has a relatively high hardness, the first axial pressure F1 required for the rubber cylinder 10 to achieve setting is relatively large, in other words, the rubber cylinder 10 deforms insufficiently under a rated first axial pressure F1, causing the rubber cylinder 10 to fail to produce a sealing effect. When a relatively soft colloid is used to fabricate the rubber cylinder 10, the rubber cylinder 10 cannot withstand a rated first axial pressure F1 to collapse consequently or the rubber cylinder 10 can withstand the first axial pressure F1 but still collapse when subsequently the rubber cylinder bears the second axial pressure F2.

Figure 5:
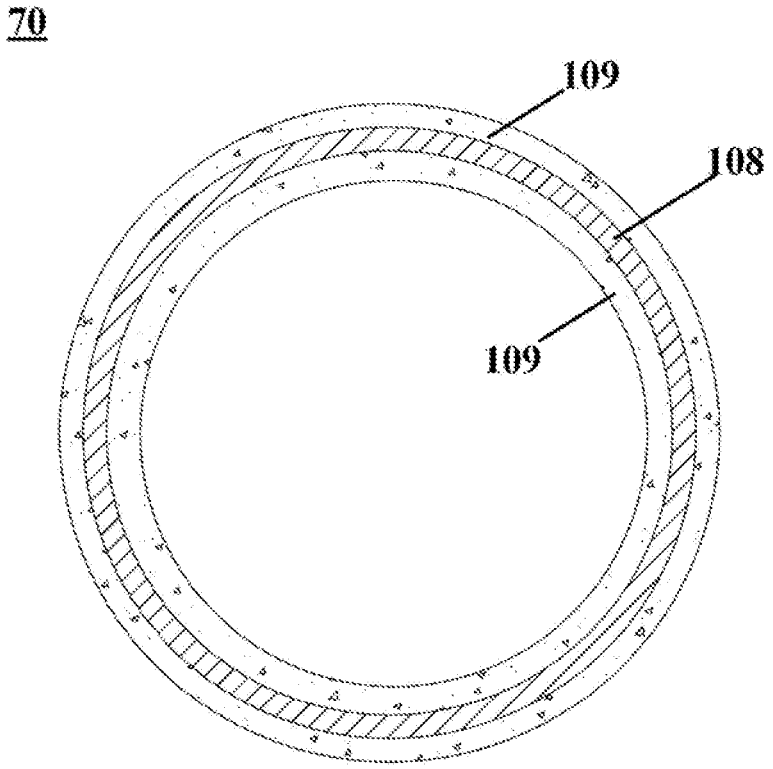
FIG. 5 is a schematic structural view of a seal ring according to an embodiment of the present application.

In resolving the problem that the rubber cylinder 10 is relatively soft, the inventors used to mix a colloid with a plurality of high-temperature high-pressure resistant filaments such as graphite packing fibres and glass filaments that are separate from each other. Such a structure can resolve to a particular degree the problem that the rubber cylinder 10 is overall slightly soft. However, the inventors further find that although the mixed filaments are all connected to the colloid, the filaments are basically not connected or are rarely connected to each other. Therefore, a hardness of the rubber cylinder 10 can only be increased in a very limited manner. Therefore, the inventors design the following technical solution: As shown in FIG. 5, a plurality of filaments intersecting each other are used to form one base body 108, and a colloid 109 is distributed on the surface of the base body 108 and bonds the filaments to form a seal ring 70. The seal ring 70 with such a structure has ductility in the radial direction. In other words, because the filaments are tangled with each other to enable the seal ring 70 to have an increased diameter within a particular range without breaking (mainly the breaking of a filament), as the diameter of the seal ring 70 becomes larger, filaments intersecting each other cancel out a part of the first axial pressure F1 that enables the diameter of the seal ring 70 to become larger, so that if the diameter of the seal ring 70 needs to be increased to a particular degree, a larger first axial pressure F1 needs to be provided. Especially, the colloid 109 tightly connects the intersecting filaments together. To enable the diameter of the seal ring 70 to be increased to a particular degree, a larger first axial pressure F1 is needed. In summary, the filaments intersect to form a resisting force, and the colloid 109 bonds the filaments to further form a resisting force. Under the effects of the two resisting forces, it is relatively difficult to compress the overall rubber cylinder 10. This is equivalent to that the rubber cylinder 10 becomes overall harder. When the seal ring 70 has an approximately the same quantity of filaments in a particular volume, the inventors find that a thickness of a seal ring can be changed to adjust the quantity of filaments intersecting each other, so that the magnitude of the required first axial pressure F1, that is, the magnitude of a setting force applied to the rubber cylinder 10, can further be adjusted. Similarly, the quantity of filaments in a particular volume of the seal ring 70 can be increased to adjust the quantity of filaments intersecting each other, so that the magnitude of the required first axial pressure F1 can further be adjusted. A hardness of a seal ring 70 at an upper end fabricated in the foregoing two manners is greater than a hardness of a seal ring 70 in the middle.

Referring back to FIG. 5, for the clarity of structure, FIG. 5 only shows the colloid 109 covering the entire surface of the base body 108, but does not show the colloid 109 that permeates in the base body 108. As a description of the surface here, for example, when the base body 108 has a circular cross section, the colloid 109 in FIG. 5 is located on a circumferential surface of the base body 108. In FIG. 5, the base body 108 is formed by aggregating a plurality of high-temperature high-pressure resistant filaments. For example, the filament may be a glass fibre, a carbon fibre or another high-temperature high-pressure resistant material. In an embodiment, the filaments are interwoven in warp and weft to form the base body 108. In another embodiment, the filaments may further be woven in another manner to form the base body 108.

A thickness of the base body 108 in FIG. 5 is 1.8 cm to 2.5 cm, and a quantity of base bodies may be chosen to be 2 to 12. In the embodiment shown in FIG. 11, six seal rings 70 are provided, and the quantity of the base bodies 108 is also 6. The diameter of a filament is chosen to be 7 μm to 30 μm. In this way, one seal ring 70 can have a huge quantity of filaments, so that the hardness of the rubber cylinder 10 can be greatly improved. According to experiments by the inventors, the thickness of the base body 108 preferably does not exceed 2 cm. This is because the inventors find that a colloid fluid forming the colloid 109 needs to permeate in the base body 108 to form the seal ring 70, but as the thickness of the base body 108 increases, a permeation speed of the colloid fluid gradually decreases. Especially, after the thickness of the base body 108 is greater than 2.5 cm, the permeation speed of the colloid fluid becomes very slow. Therefore, the thickness of each base body 108 is 2 cm in an embodiment, and may be 1.8 cm or 2.5 cm in another embodiment.

As can be learned from the foregoing description, in the technical solution of the present application, the filament does not necessarily need to have elasticity. This is because the contraction and expansion of the rubber cylinder 10 is completed by the colloid 109. As discussed above, the colloid 109 is distributed on the surface of the base bodies 108 and inside the base bodies 108, and bonds the filaments. The ideal case is that the colloid 109 bonds each filament and bonds the filaments together intersecting each other.

The copper sheet covering the rubber cylinder 10 is described below in detail.

The inventors find that after the problem of the extruded shoulder 107 is resolved, a sealing effect can be produced if a suitable material is chosen for the rubber cylinder 10. However, the seal of the rubber cylinder 10 still fails after a very short time (for example, six hours) in a high-temperature high-pressure environment. By researching and analysing failing rubber cylinders 10, it is found that most rubber cylinders fail not because the extruded shoulder 107 ruptures but because the lower end portion 106 of the rubber cylinder 10 is putrefied. It is found through researches that such putrefaction occurs because small molecules of high temperature and high pressure steam contained in a downhole gas cause a polymeric rubber cylinder to degrade. After the rubber cylinder 10 is sealed, only a lower surface of the lower end portion 106 directly contacts the downhole gas. As a result, the rubber cylinder 10 degrades and fails from bottom to top.

Figure 6:
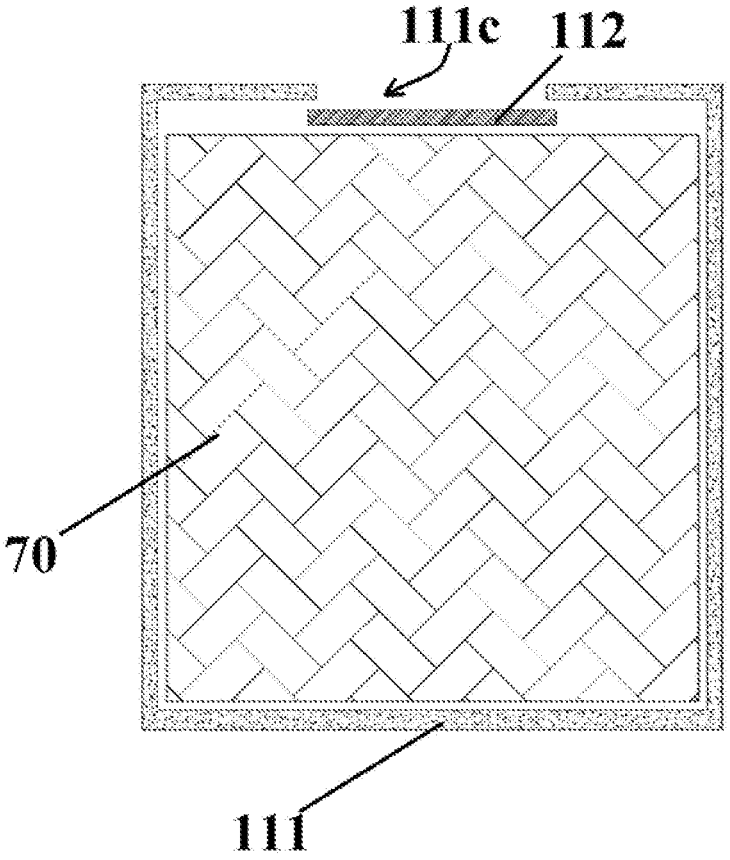
FIG. 6 is a schematic sectional view of a seal ring according to an embodiment of the present application.

In the embodiment shown in FIG. 6, the seal ring 70 is covered with a first copper sheet 111. The first copper sheet 111 covers a lower surface (a lower part), an inner side surface (a left part), and an outer side surface (a right part) of the seal ring 70. As can be seen, the first copper sheet 111 has an opening 111*c*. The opening 111*c* is located on an upper surface of the seal ring 70, and extends along the upper surface of the seal ring 70. In an embodiment, referring to FIG. 5, the opening 111*c* may alternatively reduce along the upper surface of the seal ring 70 into one hole. The opening 111*c* or the hole is designed for residual gas inside the seal ring 70 to flow out in a case of high temperature and high pressure. When a seal ring disposed on an upper portion presses the hole, high temperature and high pressure gas can further be prevented from flowing in through the hole. In the embodiment shown in FIG. 6, the opening 111*c* covers a second copper sheet 112. In another embodiment, the second copper sheet 112 may further be used to cover the opening 111*c*.

It must be considered that the seal ring 70 is annular, and therefore the first copper sheet 111 covering the seal ring 70 is also annular. The annular first copper sheet 111 ruptures easily at a bend. Therefore, in the embodiment shown in FIG. 7, the first copper sheet 111 covers the upper surface, the lower surface, and the outer side surface of the seal ring 70 but does not cover the inner side surface (a left part) of the seal ring 70. In this way, the first copper sheet 111 only needs to be bent once to be formed, so that the production efficiency of the first copper sheet 111 is improved. It is mentioned above that "the inner surface 102 and the central tube 30 have a relatively small gap (are nearly attached to each other), and the outer surface 101 and the casing 40 have a relatively large gap". Therefore, the seal ring 70 only needs a very small inward protrusion to be sealed with the central tube 30, but needs a very large outward protrusion to be sealed with the casing 40. Therefore, a surface that is not covered with a copper sheet is not chosen to be the outer side surface but is chosen to be the inner side surface.

Figure 7:
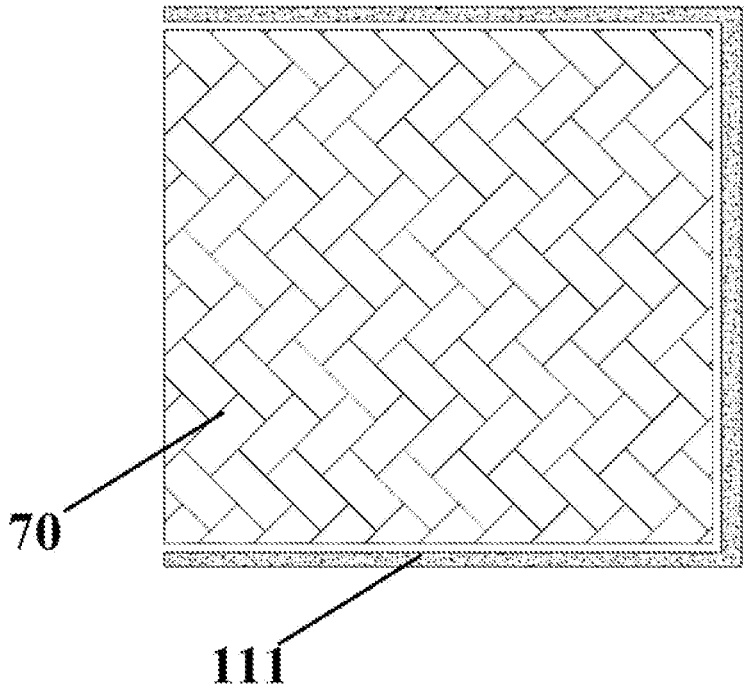
FIG. 7 is a schematic sectional view of a seal ring according to an embodiment of the present application.

Referring to FIG. 7, an opening edge of the first copper sheet 111 in FIG. 7 is flush with an inner side surface of the seal ring 70. Such a design is to protect the upper and lower surfaces of the seal ring 70 as much as possible if the inner side surface is not covered with a copper sheet, thereby mitigating the effect of degrading the seal ring 70 by high temperature and high pressure steam.

Figure 8:
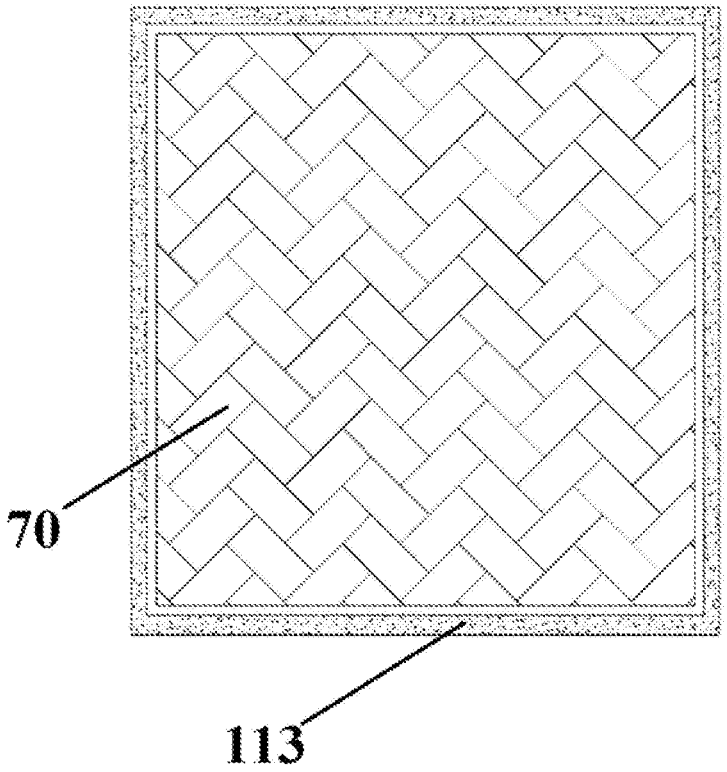
FIG. 8 is a schematic sectional view of a seal ring according to an embodiment of the present application.

In the embodiment shown in FIG. 8, the seal ring 70 is covered with a third copper sheet 113. The third copper sheet 113 covers the lower surface, the inner side surface, the outer side surface, and the upper surface of the seal ring 70, or the third copper sheet 113 covers the upper surface, the lower surface, and the outer side surface of the seal ring 70 but does not cover the inner side surface of the seal ring 70. When the first copper sheet 111 further covers an upper surface of a graphite seal ring 73 at a lower end, the shape of the first copper sheet is the same as that of the third copper sheet 113.

Figure 9:
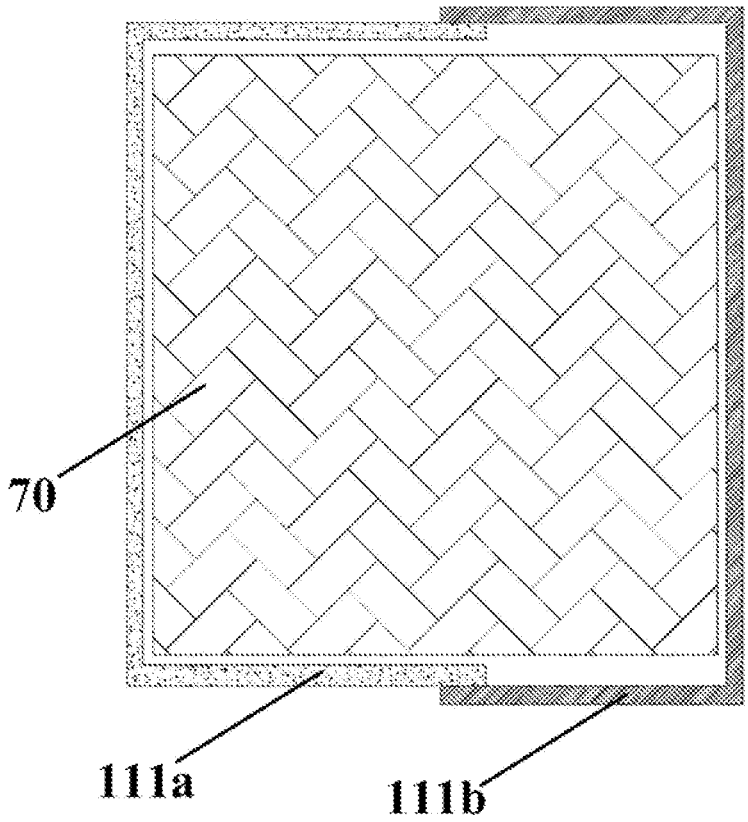
FIG. 9 is a schematic sectional view of a seal ring according to an embodiment of the present application.

In the embodiment shown in FIG. 9, the seal ring 70 is covered with an inner side copper sheet 111*a* and an outer side copper sheet 111*b*. The inner side copper sheet 111*a* covers a part of the lower surface, the entire inner side surface (a left part), and a part of the upper surface of the seal ring 70. The outer side copper sheet 111*b* covers a part of the lower surface, the entire outer side surface (a right part), and a part of the upper surface of the seal ring 70. Moreover, the upper surfaces and the lower surfaces of the inner side copper sheet 111*a* and the outer side copper sheet 111*b* both have parts overlapping each other.

Figure 10:
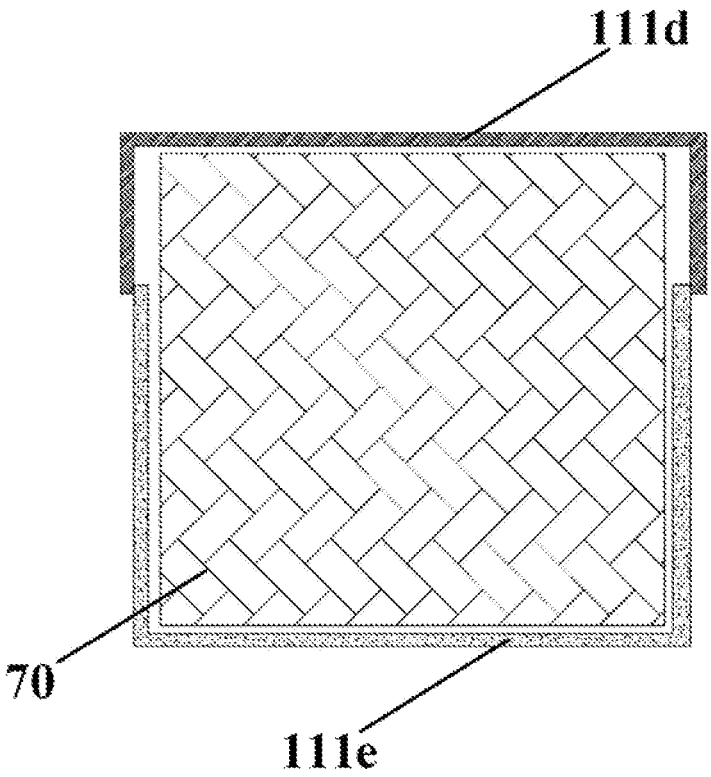
FIG. 10 is a schematic sectional view of a seal ring according to an embodiment of the present application.

In the embodiment shown in FIG. 10, the seal ring 70 is covered with an upper side copper sheet 111*d* and a lower side copper sheet 111*e*. The upper side copper sheet 111*d* covers a part of the inner side surface, the entire upper surface (the upper part), and a part of the outer side surface of the seal ring 70. The lower side copper sheet 111*e* covers a part of the inner side surface, the entire lower surface (the lower part), and a part of the outer side surface of the seal ring 70. Moreover, the inner side surfaces and outer side surfaces of the upper side copper sheet 111*d* and the lower side copper sheet 111*e* both have parts overlapping each other. In an embodiment, a position in which the upper side copper sheet 111*d* and the lower side copper sheet 111*e* are overlapped is welded to prevent direct contact between small molecules of high temperature and high pressure steam and the seal ring 70.

By using the embodiments shown in FIG. 9 and FIG. 10, the quantity of the bends of first copper sheets 111 is reduced, the first copper sheet 111 is prevented from rupturing easily at bends, and the production efficiency of the first copper sheet 111 is improved.

Referring to FIG. 11, when two graphite seal rings 73 at the lower end are covered with the copper sheet in FIG. 6, FIG. 8 or FIG. 9, small molecules in high temperature and high pressure steam can be prevented from corroding and degrading the graphite seal ring 73 at the lower end. Further, because the graphite seal ring 73 at the lower end only abuts the central tube 30 and the casing 40, only a slight sealing effect is produced. A gap may exist between the graphite seal ring 73 at the lower end and the casing 40. Therefore, a copper sheet also needs to cover an outer side surface of the graphite seal ring 73 at the lower end. Because the upper surface of the graphite seal ring 73 at the lower end is pressed by the lower surface of the wire seal ring 71, the direct contact with small molecules in high temperature and high pressure steam is eliminated. From this aspect, the upper surface of the graphite seal ring 73 at the lower end does not need to cover a copper sheet. If so, an opening of the copper sheet is definitely located on the outer side surface of the graphite seal ring 73 at the lower end. In this way, when the rubber cylinder 10 is compressed and deforms radially, the opening of the copper sheet can cause the wire seal ring 71 to rupture. Therefore, in the embodiment shown in FIG. 6, the opening 111*c* is located on an upper surface. To further eliminate the direct contact with small molecules in high temperature and high pressure steam, the opening 111*c* covers the second copper sheet 112. The inner side copper sheet 111*a* and the outer side copper sheet 111*b* in FIG. 9 both have a "U"-shaped structure. During mounting, the inner side copper sheet 111*a* may first be sleeved over the seal ring 70 from the inner side surface, and the outer side copper sheet 111*b* is sleeved over the seal ring 70 and a part of the inner side copper sheet 111*a* from the outer side surface. By using such a structure, the copper sheet can be conveniently mounted on the seal ring 70, so that the mounting efficiency is improved. For two graphite seal rings 73 at the upper end, the structure obtained after the two graphite seal rings 73 and the copper sheet are combined may be the structure shown in FIG. 6, FIG. 8 or FIG. 9. For the structure shown in FIG. 6, the first copper sheet 111 and the second copper sheet 112 are both rotated by 180 degrees for use. In this case, the opening 111*c* is pressed by an upper surface of the filament seal ring 72. Such a structure can prevent the opening 111*c* from being opened. Through the description of the structure shown in FIG. 6 being respectively used as the upper end and the lower end, it may be known that each opening 111*c* should be pressed by an adjacent seal ring, to prevent the opening 111*c* from being opened when the first axial pressure F1 or the second axial pressure F2 is applied. The structure in FIG. 8 may be implemented by using the copper sheet to cover the seal ring 70 and then performing welding at a gap. For the structure in FIG. 9, the reason that an overlapping part of the inner side copper sheet 111*a* and the outer side copper sheet 111*b* is disposed on the upper surface and the lower surface of the seal ring 70 lies in that, when the overlapping part of the inner side copper sheet 111*a* and the outer side copper sheet 111*b* is disposed on the inner side surface or the outer side surface of the seal ring 70, it may cause an adjacent seal ring to rupture during compression by the first axial pressure F1 or the second axial pressure F2. Moreover, when the overlapping part is disposed on the upper surface and the lower surface of the seal ring 70, and an adjacent seal ring may press the overlapping part, so that the direct contact with small molecules in high temperature and high pressure steam is further eliminated. A position in which the inner side copper sheet 111*a* and the outer side copper sheet 111*b* are overlapped in FIG. 9 is welded to form the structure shown in FIG. 8. Moreover, the thickness of the copper sheet may be set to prevent an extruded shoulder from rupturing under the second axial pressure F2. In an embodiment, the thickness of the copper sheet is 1 mm.

It should be particularly noted that the seal ring 70 is covered with a copper sheet. A very large pressure is needed to implement a seal between the seal ring 70 and the central tube 30 and the casing 40, that is, a seal between metal and metal. In an embodiment of the present application, the wire seal ring 71 and the filament seal ring 72 that are not covered with a copper sheet are comprised. A graphite seal ring 73 at the lowest end prevents most of the high temperature and high pressure steam. A graphite seal ring 73 at a second lowest end further prevents a part of the high temperature and high pressure steam. In this way, a very small amount of high temperature and high pressure steam reaches the wire seal ring 71 and the filament seal ring 72, thereby effectively reducing the corrosion and degradation of the wire seal ring 71 and the filament seal ring 72 by high temperature and high pressure steam and increasing the duration of a seal of the rubber cylinder 10.

Figure 12:
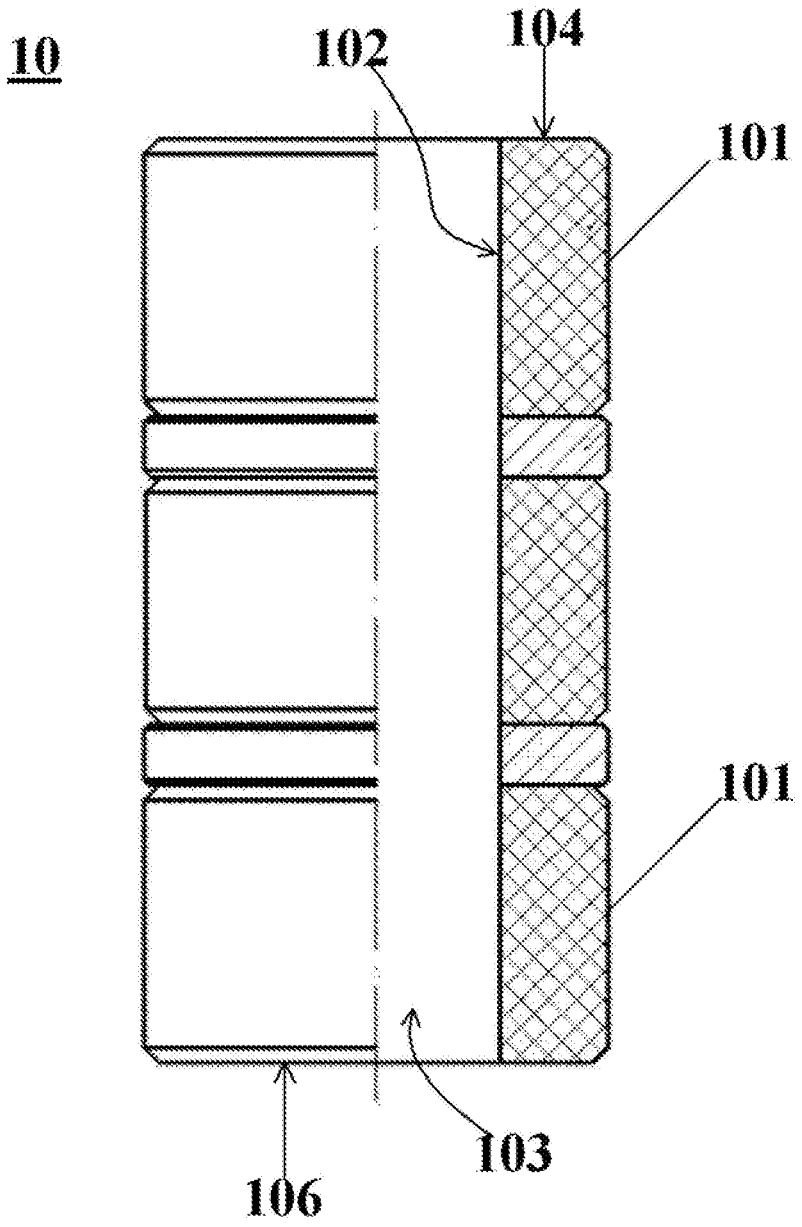
FIG. 12 is a schematic structural view of a three-section rubber cylinder according to an embodiment of the present application.

As shown in FIG. 12, when the rubber cylinder 10 has three sections, each section of the rubber cylinder may be one separate rubber cylinder. In this way, the rubber cylinder 10 shown in FIG. 12 is equivalent to being formed by joining in the axial direction three rubber cylinders independent of each other. FIG. 12 only uses an example in which the rubber cylinder 10 has three sections. In another embodiment, the rubber cylinder may further have another quantity of sections, for example, two sections or five sections.

In the embodiment shown in FIG. 11, an abutting first spacer ring 51 is disposed below the wire seal ring 71. An abutting second spacer ring 52 is disposed above the filament seal ring 72. A hardness of the first spacer ring 51, a hardness of the second spacer ring 52, a hardness of a third spacer ring 53, and a hardness of a fourth spacer ring 54 are all greater than a hardness of the wire seal ring 71 and a hardness of the filament seal ring 72. Moreover, no spacer ring is disposed between the wire seal ring 71 and the filament seal ring 72. The third spacer ring 53 is disposed between two graphite seal rings 73 at the upper end, and the fourth spacer ring 54 is disposed between two graphite seal rings 73 at the lower end.

The spacer ring (the first spacer ring 51, the second spacer ring 52, the third spacer ring 53, and the fourth spacer ring 54) of the present application and a spacer ring in the prior art produce different effects as follows. A characteristic of a relatively high hardness of a spacer ring in the prior art is used, and spacer rings are directly disposed at two ends of the rubber cylinder 10 to prevent the generation of an extruded shoulder. In the present application, the rubber cylinder 10 is formed of a plurality of seal rings (the wire seal ring 71, the filament seal ring 72, and the graphite seal ring 73). The seal rings have different hardnesses. Therefore, under the effect of an axial pressure, the seal rings deform differently in the axial direction. For example, the filament seal ring 72 is relatively soft, and is therefore partially inserted in an adjacent graphite seal ring 73 under the effect of an axial pressure. As a result, the rubber cylinder cannot provide a seal or produce a undesirable sealing effect. Therefore, in the present application, the design of a spacer ring is to provide a uniform force-bearing plane. Therefore, a person skilled in the art may know that both an upper force-bearing surface and a lower force-bearing surface of the spacer ring in the present application should be as planar and stiff as possible. A stiff spacer ring such as the first spacer ring 51, the second spacer ring 52, the third spacer ring 53, or the fourth spacer ring 54 can uniformly apply pressures to an upper surface and a lower surface that the stiff spacer ring contacts, thereby preventing the upper surfaces or the lower surfaces of the wire seal ring 71, the filament seal ring 72, and the graphite seal ring 73 from becoming uneven under an axial pressure.

No spacer ring is disposed between the wire seal ring 71 and the filament seal ring 72. The reason lies in that when being subject to a pressure, the wire seal ring 71 and the filament seal ring 72 are integrated and produce a sealing effect together. If a spacer ring is disposed, the wire seal ring 71 and the filament seal ring 72 surround the spacer ring under the effect of a pressure and then expand in a radial direction for sealing. This definitely impairs the sealing performance. The first spacer ring 51, the second spacer ring 52, the third spacer ring 53, and the fourth spacer ring 54 are made of a metal material, for example, an aluminium material or an iron material. When an aluminium material is used, the thickness of the first spacer ring (51) is D1, the thickness of the second spacer ring (52) is D2, 4 mm≤D1≤6 mm, and 4 mm≤D2≤6 mm Preferably, D1 and/or D2 is 5 mm Because an iron material has a high hardness, when an iron material is used, 2 mm≤D1≤4 mm, 2 mm≤D2≤4 mm Preferably, D1 and/or D2 is 3 mm.

In the embodiment shown in FIG. 11, when the rubber cylinder 10 is not subject to the first axial pressure F1, all the seal rings 70 are parallel to the radial direction of the rubber cylinder 10. As shown in FIG. 1, when being subject to the first axial pressure F1, the rubber cylinder 10 is shortened in the axial direction but expands in the radial direction, and a graphite seal ring 73 at the lowest end then bears the second axial pressure F2.

In an embodiment of the present application, the base body 108 is a graphite packing or a carbon fibre packing. A packing is usually formed by weaving relatively soft threads, and usually has a square, rectangular, or circular cross section. In an embodiment, the base body 108 has a quadrilateral cross section, and has, for example, a square cross section. In another embodiment, the base body 108 may alternatively have a circular cross section.

The present application further provides a packer, the packer having the rubber cylinder 10 defined in one of the foregoing technical solutions.

The present application further provides a bridge plug, the bridge plug having the rubber cylinder 10 defined in one of the foregoing technical solutions.

Up to this, a person skilled in the art should recognize that although a plurality of exemplary embodiments of the present application have been shown and described in detail herein, numerous other variations or modifications meeting the principle of the present application can be directly determined or derived according to the contents disclosed in the present application. Therefore, the scope of the present application should be construed and considered as covering all of such other variations or modifications.

What is claimed is:

1. A rubber cylinder with rigid seal rings on both ends, comprising:

a through hole located at a center thereof, an inner surface located at the through hole, an outer surface corresponding to the inner surface, an upper end portion and a lower end portion respectively located at two ends of the rubber cylinder, and a middle portion located between the upper end portion and the lower end portion, the upper end portion being used to bear a first axial pressure in an axial direction, and the lower end portion being used to bear a second axial pressure opposite to the first axial pressure in the axial direction; when the first axial pressure is applied to the upper end portion, the upper end portion, the middle portion, and the lower end portion all deforming in a radial direction; and when the second axial pressure is applied to the lower end portion, the upper end portion, the middle portion, and the lower end portion all deforming in the radial direction, wherein, the rubber cylinder comprises more than one wire seal ring and more than one filament seal ring arranged in the axial direction, and one of the wire seal rings abuts one of the filament seal rings and is disposed below the filament seal ring;

the wire seal ring comprises a plurality of wires intersecting each other and a colloid bonding all the wires together;

the filament seal ring comprises a plurality of high-temperature high-pressure resistant filaments intersecting each other and a colloid bonding all the filaments together;

one rigid seal ring is disposed at an upper end of the rubber cylinder and is used as the upper end portion of the rubber cylinder, and another rigid seal ring is disposed at a lower end of the rubber cylinder and is used as the lower end portion of the rubber cylinder;

an abutting first spacer ring is disposed below one of the wire seal rings, an abutting second spacer ring is disposed above the filament seal ring abutting the wire seal ring, and a hardness of the first spacer ring and a hardness of the second spacer ring are both greater than a hardness of the wire seal ring and a hardness of the filament seal ring; and no spacer ring is disposed between the wire seal ring and the filament seal ring abutting the wire seal ring.

2. The rubber cylinder according to claim 1, wherein, the first spacer ring and the second spacer ring are both made of a metal material.

3. The rubber cylinder according to claim 2, wherein, the first spacer ring and the second spacer ring are both made of an aluminum material; and a thickness of the first spacer ring is D1, a thickness of the second spacer ring is D2, 4 mm≤D1≤6 mm, and 4 mm≤D2≤6 mm.

4. The rubber cylinder according to claim 3, wherein, the thickness of the first spacer ring and the thickness of the second spacer ring are both 5 mm.

5. The rubber cylinder according to claim 2, wherein, the first spacer ring and the second spacer ring are both made of an iron material; and a thickness of the first spacer ring is D1, a thickness of the second spacer ring is D2, 2 mm≤D1≤4 mm, and 2 mm≤D2≤4 mm.

6. The rubber cylinder according to claim 5, wherein, the thickness of the first spacer ring and the thickness of the second spacer ring are both 3 mm.

7. The rubber cylinder according to claim 1, wherein, the rigid seal rings are graphite seal rings, and each of the graphite seal rings comprises high-temperature high-pressure resistant carbon filaments intersecting each other and graphite bonding all the carbon filaments together, wherein the graphite seal ring is covered with a copper sheet.

8. A packer, comprising:

a rubber cylinder with rigid seal rings on both ends, wherein, the rubber cylinder has a through hole located at the center, an inner surface located at the through hole, an outer surface corresponding to the inner surface, an upper end portion and a lower end portion respectively located at two ends of the rubber cylinder, and a middle portion located between the upper end portion and the lower end portion, the upper end portion is used to bear a first axial pressure in an axial direction, and the lower end portion is used to bear a second axial pressure opposite to the first axial pressure in the axial direction; when the first axial pressure is applied to the upper end portion, the upper end portion, the middle portion, and the lower end portion all deform in a radial direction; and when the second axial pressure is applied to the lower end portion, the upper end portion, the middle portion, and the lower end portion all deform in the radial direction, wherein, the rubber cylinder comprises more than one wire seal ring and more than one filament seal ring arranged in the axial direction, and one of the wire seal rings abuts one of the filament seal rings and is disposed below the filament seal ring;

the wire seal ring comprises a plurality of wires intersecting each other and a colloid bonding all the wires together;

the filament seal ring comprises a plurality of high-temperature high-pressure resistant filaments intersecting each other and a colloid bonding all the filaments together;

one rigid seal ring is disposed at an upper end of the rubber cylinder and is used as the upper end portion of the rubber cylinder, and another rigid seal ring is disposed at a lower end of the rubber cylinder and is used as the lower end portion of the rubber cylinder;

an abutting first spacer ring is disposed below one of the wire seal rings, an abutting second spacer ring is disposed above the filament seal ring abutting the wire seal ring, and a hardness of the first spacer ring and a hardness of the second spacer ring are both greater than a hardness of the wire seal ring and a hardness of the filament seal ring; and no spacer ring is disposed between the wire seal ring and the filament seal ring abutting the wire seal ring.

9. A bridge plug, comprising a rubber cylinder with rigid seal rings on both ends, wherein, the rubber cylinder has a through hole located at the center, an inner surface located at the through hole, an outer surface corresponding to the inner surface, an upper end portion and a lower end portion respectively located at two ends of the rubber cylinder, and a middle portion located between the upper end portion and the lower end portion, the upper end portion is used to bear a first axial pressure in an axial direction, and the lower end portion is used to bear a second axial pressure opposite to the first axial pressure in the axial direction; when the first axial pressure is applied to the upper end portion, the upper end portion, the middle portion, and the lower end portion all deform in a radial direction; and when the second axial pressure is applied to the lower end portion, the upper end portion, the middle portion, and the lower end portion all deform in the radial direction, wherein, the rubber cylinder comprises more than one wire seal ring and more than one filament seal ring arranged in the axial direction, and one of the wire seal rings abuts one of the filament seal rings and is disposed below the filament seal ring;

the wire seal ring comprises a plurality of wires intersecting each other and a colloid bonding all the wires together;

the filament seal ring comprises a plurality of high-temperature high-pressure resistant filaments intersecting each other and a colloid bonding all the filaments together;

one rigid seal ring is disposed at an upper end of the rubber cylinder and is used as the upper end portion of the rubber cylinder, and another rigid seal ring is disposed at a lower end of the rubber cylinder and is used as the lower end portion of the rubber cylinder;

an abutting first spacer ring is disposed below one of the wire seal rings, an abutting second spacer ring is disposed above the filament seal ring abutting the wire seal ring, and a hardness of the first spacer ring and a hardness of the second spacer ring are both greater than a hardness of the wire seal ring and a hardness of the filament seal ring; and no spacer ring is disposed between the wire seal ring and the filament seal ring abutting the wire seal ring.

* * * * *